US008353175B2

(12) United States Patent
Wohlert

(10) Patent No.: US 8,353,175 B2
(45) Date of Patent: Jan. 15, 2013

(54) ROOF TOP AIR CONDITIONING UNITS HAVING A CENTRALIZED REFRIGERATION SYSTEM

(76) Inventor: Calvin Wade Wohlert, Centennial, CO (US)

( * ) Notice: Subject to any disclaimer, the term of this patent is extended or adjusted under 35 U.S.C. 154(b) by 985 days.

(21) Appl. No.: 12/319,272

(22) Filed: Jan. 5, 2009

(65) Prior Publication Data

US 2009/0173096 A1 Jul. 9, 2009

Related U.S. Application Data

(60) Provisional application No. 61/010,336, filed on Jan. 8, 2008.

(51) Int. Cl.
*F25D 23/12* (2006.01)
*F24F 3/00* (2006.01)

(52) U.S. Cl. ..... 62/259.1; 165/219; 165/220

(58) Field of Classification Search ..... 165/218, 165/219, 220, 221, 201, 62, 237, 76; 62/259.1, 62/298, 299

See application file for complete search history.

(56) References Cited

U.S. PATENT DOCUMENTS

| | | | | |
|---|---|---|---|---|
| 2,072,977 | A * | 3/1937 | Bichowsky | 62/221 |
| 3,181,604 | A * | 5/1965 | Kritzer | 165/207 |
| 4,196,776 | A * | 4/1980 | Fallon et al. | 165/76 |
| 4,242,872 | A * | 1/1981 | Shaw | 62/235.1 |
| 5,306,116 | A * | 4/1994 | Gunn et al. | 415/27 |
| 5,337,574 | A * | 8/1994 | Dick | 62/89 |
| 6,089,033 | A * | 7/2000 | Dube | 62/156 |
| 6,615,602 | B2 * | 9/2003 | Wilkinson | 62/238.7 |
| 6,883,342 | B2 * | 4/2005 | Kato et al. | 62/238.7 |
| 2001/0029747 | A1 * | 10/2001 | Gaul | 62/498 |

* cited by examiner

*Primary Examiner* — Ljiljana Ciric
*Assistant Examiner* — Jason Thompson
(74) *Attorney, Agent, or Firm* — Leyendecker & Lemire, LLC; Kurt Leyendecker

(57) ABSTRACT

A system comprising a plurality of rooftop HVAC units having a centralized refrigeration unit is described along with a method for retrofitting existing independent HVAC units into the described system. The resulting multi-unit system offers increased efficiency and reliability over independently operating HVAC units.

10 Claims, 5 Drawing Sheets

ROOF TOP AIR CONDITIONING UNITS HAVING A CENTRALIZED REFRIGERATION SYSTEM

CROSS REFERENCE TO RELATED APPLICATIONS

This application specification is a continuation of a Provisional Application for Patent No. 61/010,336 filed Jan. 8, 2008.

FIELD OF THE INVENTION

The invention relates to facilities containing multiple air-cooled packaged rooftop air conditioning or heat pump units (RTUs).

BACKGROUND

Air-cooled packaged roof top air conditioning units are perhaps the most ubiquitous type of Heating, Ventilating and Air Conditioning (HVAC) units utilized today in commercial and industrial facilities in the United States of America. This is due to their relative ease of installation and low equipment and installation cost. The down side of these units is their inherent inefficiency in terms of electrical energy consumption. These units are also higher in average maintenance costs due to compressor and condenser fan failures compared to central refrigeration and chilled water systems. This is due in part to the manufactures desire to remain competitive in markets that require low initial equipment cost.

Air-cooled packaged roof top air conditioning heat pump units are more prevalent in the southern climates due to milder winters, whereas air-cooled packaged rooftop air conditioning units with natural gas fired heating sections are more prevalent in more northerly climates due to the relatively higher heating demands these climates present.

The typical air cooled rooftop air conditioning unit contains the following major components; a supply (evaporator) fan for delivering the cooled or heated and ventilated air to the air conditioned space, an air filter section, one or multiple condenser fans for conveying ambient outdoor air across the air cooled condenser coil, one or more refrigerant compressors to drive the refrigerant cooling or heat pump cycle, a condenser coil and evaporator coil, and expansion device to regulate the flow and pressure drop of liquid refrigerant as it travels from the condenser and/or condenser liquid receiver into the evaporator coil, the main equipment housing, and the electrical and controls components. Some units also contain automated outdoor air, return air, and exhaust air dampers while others do not. Of these typical components the most common source of major maintenance cost is system failure due to failure of the condenser fan or a compressor failure. Condenser fan failures can often lead to elevated refrigeration condensing pressures (or head pressures) which causes stress on the compressor that can then lead to a costly compressor failure and equipment downtime.

For facilities with multiple RTUs the frequency of compressor or other major failures increases with the number of units per facility. In other words a facility with 20 RTUs containing 2 compressors each has a total of 40 compressors. If these units are all at their mean expected life, one could expect a compressor to fail on a typical unit once every 8 to 10 years. However since there are 40 compressors one could expect 4.4 compressors failing on average every year. In today's market a typically sized compressor replacement cost could be expected to be on the order of $5,000 to $7,000 each for a total average compressor replacement cost of approximately of $22,000 to $30,800 per year.

In addition to high maintenance costs a typical rooftop unit will have a cooling efficiency on the order of 1.0 to 1.2 kW/ton of cooling. The cooling efficiency of an air-cooled rooftop air conditioning unit is inherently limited due in large part to the dry air-cooled condenser coil. An air cooled condenser coil rejects heat to the air and therefore must be operated at a higher temperature than the surrounding ambient outdoor air such that heat transfer can take place. For facility cooling systems the peak cooling system loads are often coincident with the warmest outdoor air temperatures and the times with the highest solar radiation heat load on the facilities roofs, walls, and windows. At these times the RTUs are likely to experience high ambient outdoor air temperatures when they are also experiencing their peak cooling load demands. The primary disadvantage of an air-cooled RTU is that it is inherently limited in its efficiency by the amount of "lift" that the compressor has to perform in terms of pressure increase of the refrigerant vapor from the relatively low pressure of the evaporator coil to the relatively high pressure of the condenser coil. When it is warm outside the refrigerant compressor needs to compress the refrigerant vapor to a higher pressure to drive the heat rejection process to allow the refrigerant to condense so that it can be fed to the expansion device for subsequent liquid to vapor phase change in the evaporator (cooling) coil. By design RTUs are typically located on the roofs of facilities where they are exposed to high ambient temperatures as a result of solar heating of the rooftop surfaces which cause further efficiency losses due to high ambient air temperatures. These high ambient temperatures not only increase energy use but also cause the compressor to have to work harder per unit of cooling energy thus causing further stress and potentially reduced compressor equipment life.

In contrast to the typical RTU based cooling systems, central chilled water systems or central refrigeration systems are typically water cooled via a cooling tower system or evaporative condenser based systems. New water cooled refrigerating or chilling equipment typically have efficiencies on the order of 0.6 to 0.7 kW/ton of cooling, which is on the order of 40% less energy consumption than their packaged air cooled rooftop counterparts. The primary advantage of a water cooled systems is in the fact that by being water cooled the temperature at which they are able to reject heat is always going to be lower than or at worst case, the same as that of an equivalent air-cooled refrigeration cycle. This is due to the fact that water cooled system refrigerant condensing pressures are a function of the ambient wet-bulb temperatures which have to do with the relative dryness or wetness of the outdoor air surrounding the heat rejection equipment and are not so much a function of the air temperature its self. Air wet-bulb temperatures are always less than or in the extreme case equal to the dry-bulb temperature of that same air. The only time the wet-bulb and the dry-bulb air temperatures are equal is when the air is 100% saturated with water, or is at a state of 100% relative humidity, which is an upper limit case. Depending on local climate conditions a typical water cooled system can be expected to operate at approximately 40% less energy consumption per unit of cooling than an otherwise equivalent air cooled system.

Traditional central cooling system design for the HVAC industry involves creating chilled water loops and pumping chilled water out to chilled water air cooling coils located in the facilities air handling units. These can be units located inside the building or located on the rooftop, or any combination thereof. The down side to this approach is the water must be chemically treated to scavenge oxygen, prevent biological growth, and prevent corrosion and in some systems prevent freezing. The other downside of central pumping systems is the added temperature approach of dual heat transfer surfaces between the actual air stream to the chilled water stream and then a second heat exchange from the chilled water stream to the refrigerant in the water chilling machine. This results in increased energy as a result of added temperature differential between the working fluid, which is the refrigerant and the medium to be cooled, which is the buildings HVAC system air stream in the air handling unit(s). Chilled water systems are also require much larger pipes, and significantly increased pumping power as compared to a circulating cooling medium such as a refrigerant which is undergoing a phase change and is therefore capable of moving significantly more Btu's per lb. of circulating refrigerant than that of a chilled water system, thereby reducing pumping costs and piping material costs.

Another point to consider is that central chilled water of refrigeration system equipment is typically much larger cooling capacity equipment than would be found in a typical rooftop unit. Central refrigerating or cooling equipment is typically on in the size range of 200 to 1,000 tons of cooling capacity vs. a typical RTU compressor is typically in the cooling capacity size range 5 to 30 tons of cooling capacity. The larger capacity equipment found in central systems are typically a much larger investment and as such are less of a commodity grade type of equipment when compared to a compressor package in a typical RTU. In central systems the facility owner or design engineer is typically responsible for selecting the compressor systems that go into the cooling system design. In RTUs the equipment manufacturer, who is more driven by market forces focused on low first equipment cost, is the party whom selects and installs the compressor system which is delivered as part of their RTU package. Due to these market conditions centralized systems tend to be built with the end consumer in mind vs. the mass producer of RTUs and as such life expectancy and efficiency are a stronger driving market force that in the RTU market. In the RTU market the smaller compressors are at the point of being more or less a consumable items often with little or no serviceable components, that upon failure the entire unit is simply replaced, versus in the central chilling or refrigeration market, equipment is designed and built to be highly efficient and equipment is designed to last on the order of 15 to 25 years with serviceable components. Centralized refrigeration or chilled water equipment is not designed to be low cost disposable types of equipment to the extent that is done in the RTU market.

Added efficiency can be gained for facilities with diverse heating and cooling zones, whereby heat from zones which are requiring cooling could be operated off of the evaporator side of the heat pump system while at the same time for zones that require heating energy can operate as the condenser when in heat pump mode. In this way heat is removed from the warm zones which are requiring cooling and this heat is then transferred to other zones which are requiring additional heat or reheat.

All of these aforementioned items translate into increased reliability, efficiency, and lower maintenance costs for centralized water cooled systems compared to typical air-cooled RTU based cooling systems.

DETAILED DESCRIPTION

Embodiments of the present invention include the equipment and processes necessary to convert packaged air-cooled rooftop HVAC units so that they may be served off of a centralized, water-cooled, refrigeration system thereby increasing the energy efficiency and reliability of the HVAC units, and potentially reducing maintenance costs for facilities with multiple packaged air-cooled rooftop HVAC units.

Embodiments of the system and process of this invention consist of a centrally fed refrigeration system which will supply liquid refrigerant under pressure via a refrigerant piping system to each RTU's evaporator coil. Refrigerant gasses evolved during the cooling process will then be removed from each evaporator coil then transferred back via the refrigerant piping system to the newly supplied central refrigeration plant for recompression and re-liquefaction.

Figure 3:
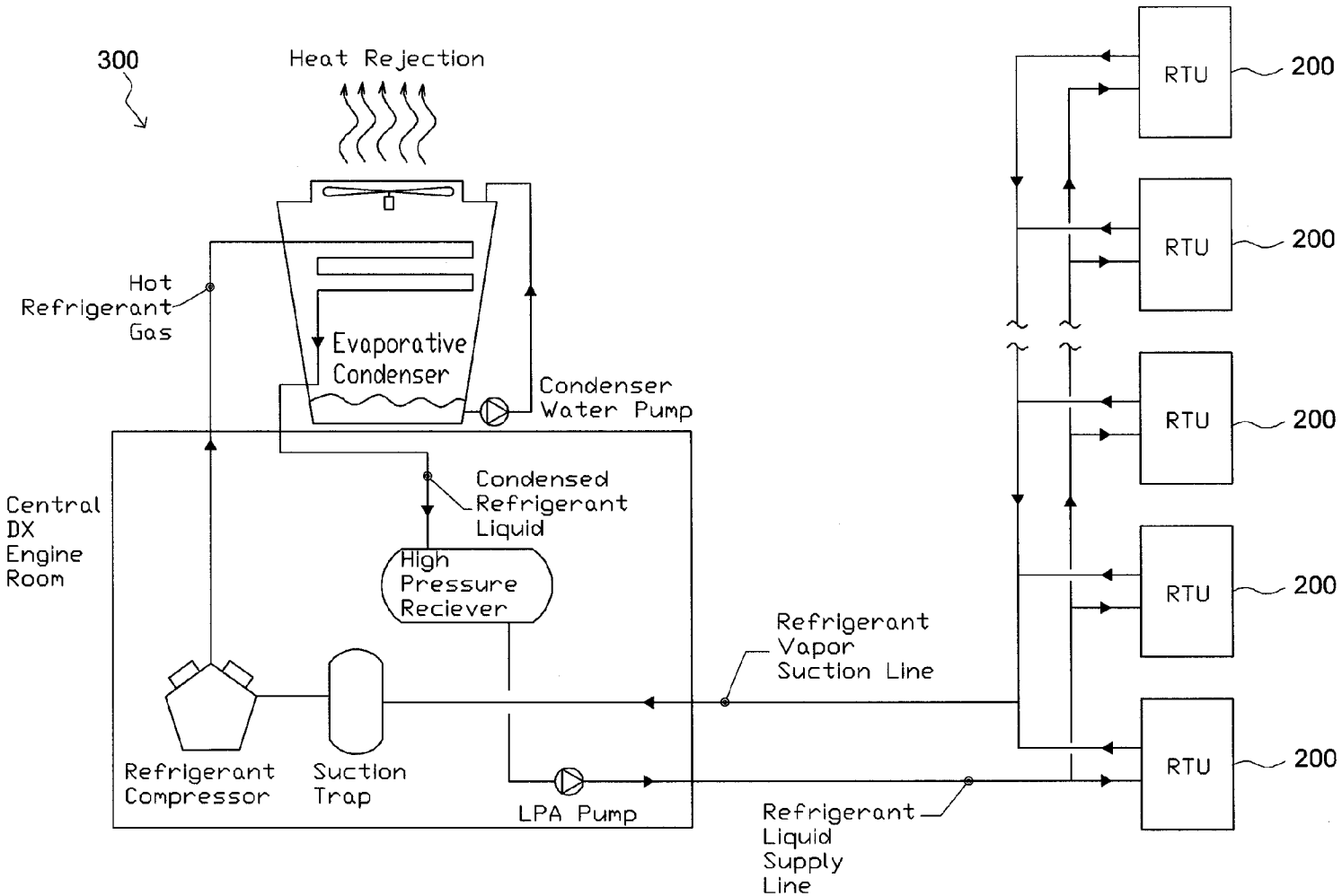
FIG. 3 is a basic schematic representation of an embodiment of the present invention.

Embodiments of the central refrigerant system utilized as a necessary component of this invention would consist of all of the normal components associated with a central industrial refrigeration system which may include, but are not limited to, one or more refrigeration compressors, oil separators and oil management system (if required), suction trap(s), evaporative condenser(s), or cooling tower(s) and heat exchanger(s), and refrigerant liquid pressure amplification pumps, if desired. Refer to FIG. 3 for a schematic illustration of a typical central refrigeration system layout.

One of the unique benefits of embodiments of this invention is that when utilized in a retrofit application scenario the existing RTUs remain intact with the local RTU compressors, condenser fans, and condenser coils bypassed and electrically locked out. In the event of a central system failure, or in the event that the facility desires to discontinue use of the central system, the existing RTUs can be easily brought back online to their original stand alone mode of operation by simply re-enabling the RTU compressor, condenser, and condenser fan, and closing off the central system refrigerant suction and liquid lines via the installed valving and opening the suction and liquid refrigerant lines via the installed valving to enable the existing onboard compressor, condenser, and condenser fan to return to their normal operation.

One embodiment of this invention utilizes a modular or containerized system which can be brought on site in prefabricated engine room, or engine room sections, to enhance modularity and reduce installation costs. Under such a scenario the system could be deployed easily to serve existing facilities which already have multiple RTUs. The system would represent a unique retrofit opportunity for these types of facilities as a means of lowering operating costs and reducing energy consumption.

The system can utilize multiple stage compressors to increase efficiency of the system. (This can be particularly useful in supermarket applications where low and medium temperature refrigeration is already required as part of the facilities normal operation. The central refrigeration system that is utilized for food storage, preservation, and display cases can be expanded to also service the roof top units from one efficient centralized refrigeration system.)

The central refrigeration system can be combined with a refrigerant liquid pumped heat pipe configuration utilizing a thermal storage medium to lower on peak demand costs. The thermal storage system consists of a phase change thermal storage medium which acts as a refrigerant condenser operating at a temperature below that of the evaporator coils. Under this scenario refrigerant vapor naturally migrates from the evaporator coil to the low temperature reservoir of the thermal storage device, the refrigerant vapor then condenses when it comes in contact with the cold thermal storage device. The condensed liquid is then be pumped via a refrigerant liquid pressure amplification pump to feed the evaporator coils in each RTU during periods when peak electrical demand shaving is desired. If temperature differentials or piping constraints limit the effectiveness of this thermal storage electrical load demand shifting configuration one or more low pressure blowers can be utilized to help move and pressurize the refrigerant vapor as it travels from the evaporator coils to the thermal storage condenser.

Figure 1:
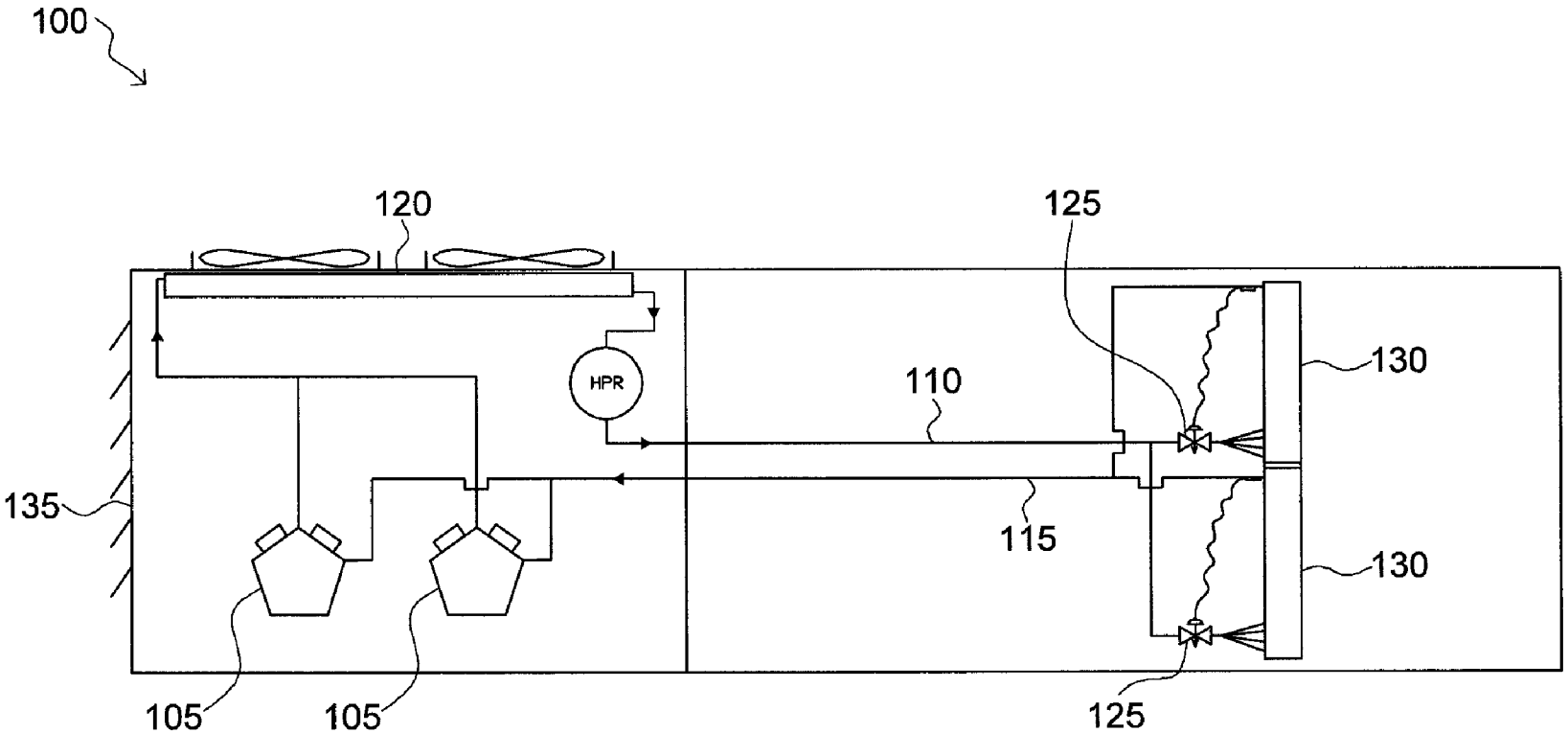
FIG. 1 Prior Art
FIG. 1 is a schematic view of a typical prior art cooling only Roof Top Unit (RTU).

FIG. 1 represents a schematic view of a typical prior art cooling only RTU 100. The figure shows the components relevant to the scope of this invention, including refrigeration compressors 105, liquid and vapor refrigerant piping 110 & 115, air cooled condenser coils 120 and condenser fans, expansion devices 125, cooling/evaporator coils 130, and overall RTU housing 135. Heating components are often included in typical RTUs of various types, but heating sections are not required depending on the location and application, and are not relevant to the scope of this invention and therefore are not illustrated in the figure. Air source heat pump RTUs are relevant to the field of this invention and they are discussed in another figure. FIG. 1 represents a basic schematic diagram of the prior art of a conventional RTU 100 and is presented to serve as the basis against which the modifications pertaining to embodiments of the present invention can be clearly demonstrated in subsequent figures.

Figure 2:
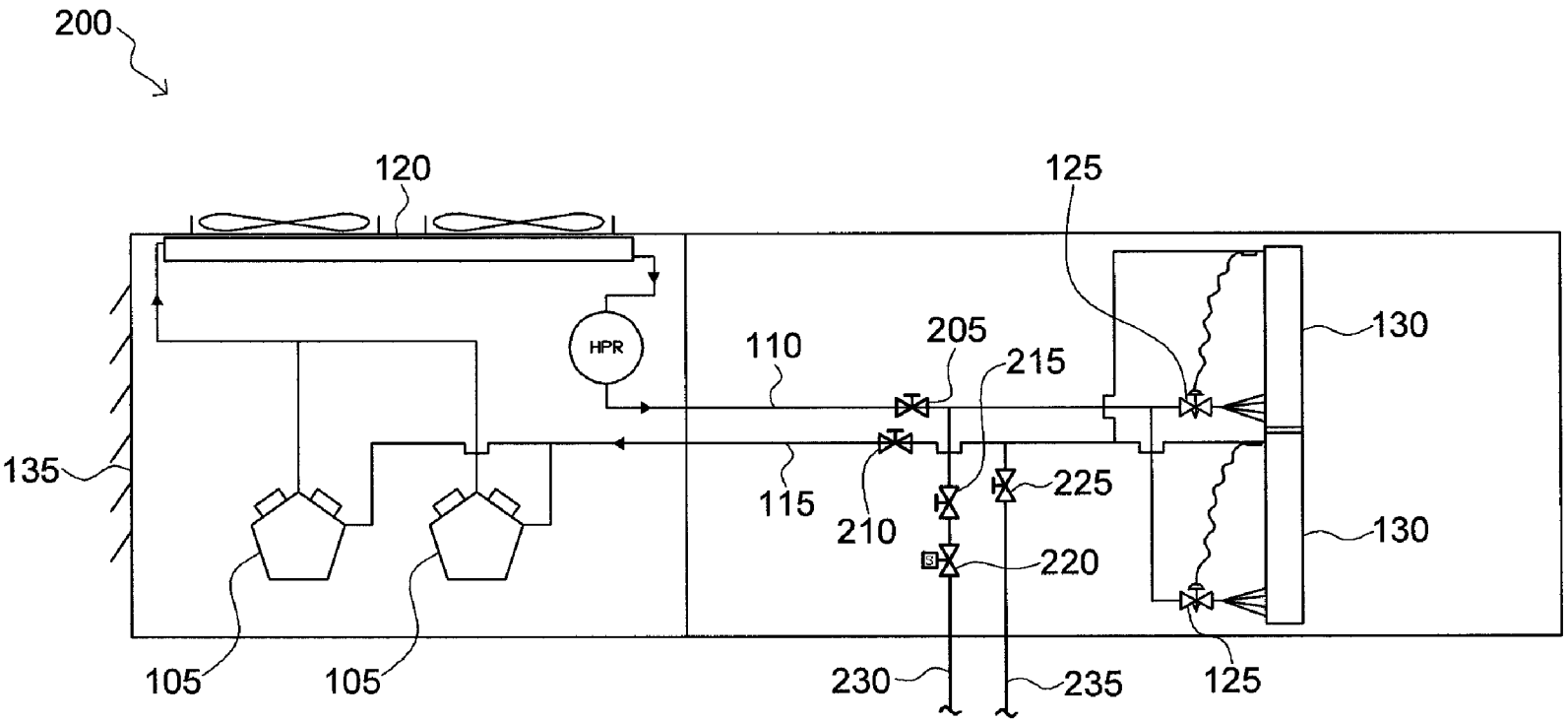
FIG. 2 is a schematic view of a retrofitted version of the prior art system of FIG. 1 according to an embodiment of the present invention.

FIG. 2 is a schematic of a retrofitted RTU 200 based on the RTU 100 of FIG. 1 according to an embodiment of the present invention. FIG. 2 represents a schematic view of a typical RTU 200 that has been modified through the invention described herein to be served by a centralized, refrigeration system (see FIG. 3). Accordingly, the components and elements of the retrofitted RTU are the same as those identified for the RTU 100 of FIG. 1 unless otherwise specifically noted. Isolation valves 205, 210, 215 and 220 are in place to enable isolation and switching back and forth between the original existing RTU compressor 105 and condenser 120 circuit and the centralized refrigeration system (see FIG. 3). When operated off of the centralized refrigeration system isolation valves 205 and 210 are normally in the closed position thereby blocking refrigerant flow to and from the RTU's compressor(s) 105 and air-cooled condenser 120 and isolation valves 215 and 225 are normally in the open position thereby enabling refrigerant flow to and from the centralized refrigerant system via conduits 230 & 235 to and from the RTU's evaporator/cooling coil(s) 130. Conduit 230 supplies a pressurized refrigerant liquid from the centralized refrigeration system to the RTU. Conduit 235 returns refrigerant vapor, and potentially liquid if a liquid overfeed system is employed, from the RTU to the centralized refrigeration system. Conversely, when functioning off of the original existing RTU compressor and condenser circuit, isolation valves 205 & 210 are normally in the open position thereby enabling refrigerant flow to and from the original existing RTU compressor and condenser circuit, and isolation valves are normally in the closed position thereby blocking refrigerant flow to and from the centralized refrigeration system. On a call for cooling by the RTU, the RTU's compressor(s) 105 would normally, prior to the modifications of the present invention, be engaged to collect and compress refrigerant vapor from the evaporator/cooling coil(s) 130 and send this pressurized gas to the condenser coil 120 where is can reject heat and be returned to a liquid state. Rather than engaging the compressor when there is a demand for cooling on the RTU, the embodiment of the retrofitted system of this invention would open up solenoid valve 220 to allow liquid refrigerant via conduit 230 from the centralized system to enter the evaporator/cooling coil 130 via an expansion, or pressure letdown device 125. A portion of, or all of, the refrigerant in the evaporator/cooling coil would absorb heat and go through a phase change from a liquid to a gas just as it normally would in a standard refrigeration cycle. The refrigerant gas would then be returned to the centralized refrigeration system via conduit 235 for compression and re-liquefaction via a centralized water cooled condenser system.

FIG. 3 is a basic schematic representation of an embodiment of the present invention. FIG. 3 shows a centralized refrigeration system supplying and returning refrigerant to and from multiple RTUs 100 that have been converted to be served by the centralized water-cooled refrigeration system 300. The intent of FIG. 3 is to illustrate how a water-cooled centralized system could be used to connect to and server multiple RTUs via a common central refrigeration system. FIG. 3 has been provided to aid the reader with conceptual clarity and is not intended to be an all inclusive drawing as many variations to this basic conceptual representation could exist and are considered within the scope of the present invention. It is assumed that the reader has a basic understanding of typical vapor compression refrigeration systems and as such further elaboration was deemed not necessary for this FIG. 3.

Figure 4:
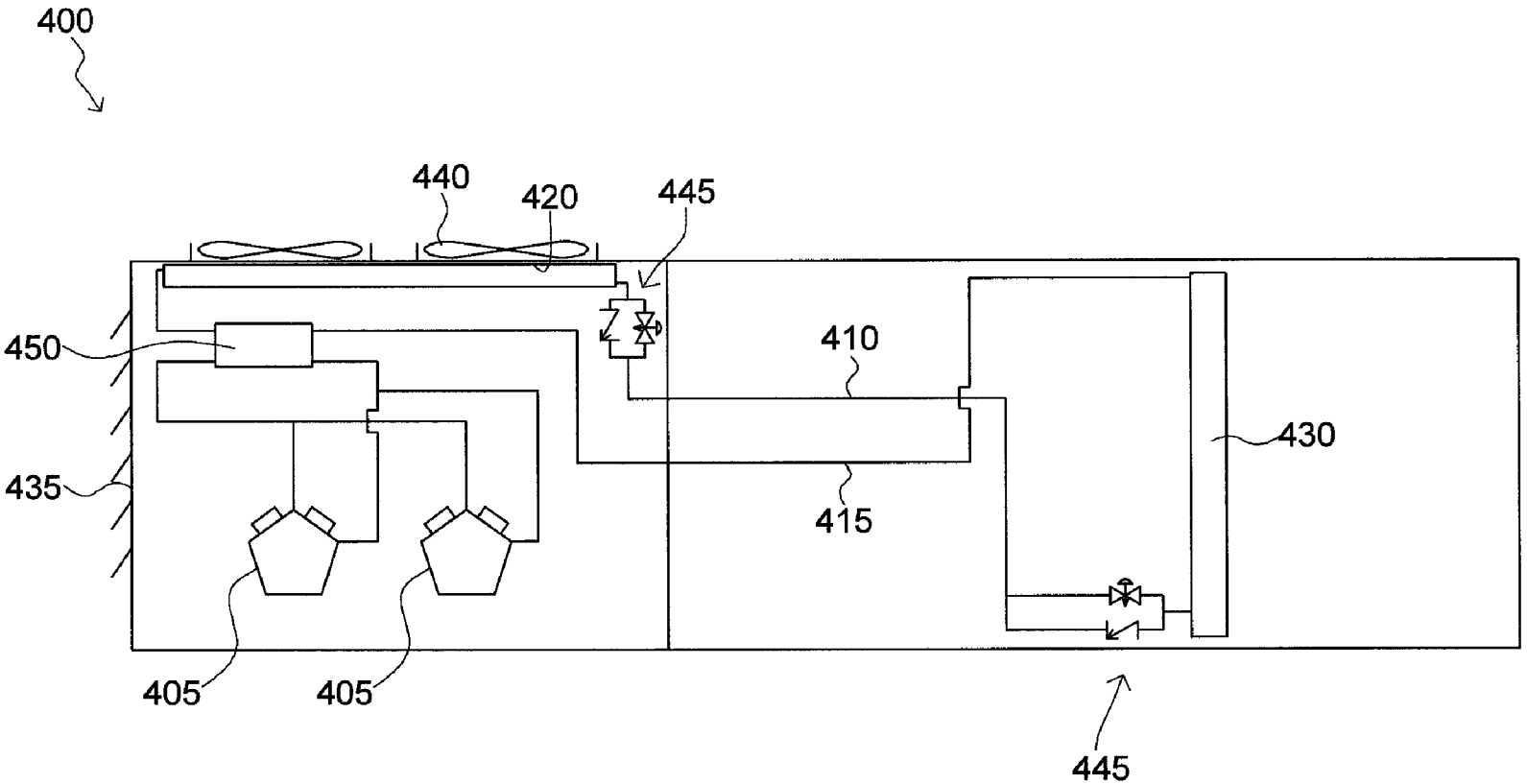
FIG. 4 Prior Art
FIG. 4 is a schematic view of a typical prior art air source heat pump RTU.

FIG. 4 represents a schematic view of a typical prior art air source heat pump RTU 400. The figure shows the components relevant to the scope of this invention, including refrigeration compressors 405, liquid and vapor refrigerant piping 410 & 415, air cooled outdoor coils 420 which can serve as either a refrigerant condenser when in cooling mode, or a refrigerant evaporator when in heating mode, outdoor coil fans 440, expansion devices & check valves 445, heat pump reversing valve 450, indoor heating/cooling coils 430, and overall RTU housing 435. The indoor coil serves as a cooling coil/refrigerant evaporator when the RTU is in cooling mode and a heat coil/refrigerant condenser when the RTU is in heat pump heating mode. Supplemental heating components of various types are often included in typical heat pump RTUs to provide additional heating capacity during very cold or high heating demand periods, however supplemental heating sections are not always required depending on the location and application, and are not relevant to the scope of embodiments of this invention and therefore are not illustrated in the figure. FIG. 4 represents a basic schematic diagram of the prior art of a conventional air source heat pump RTU and is presented to serve as the basis against which the modifications of the present invention can be clearly demonstrated in subsequent figures.

Figure 5:
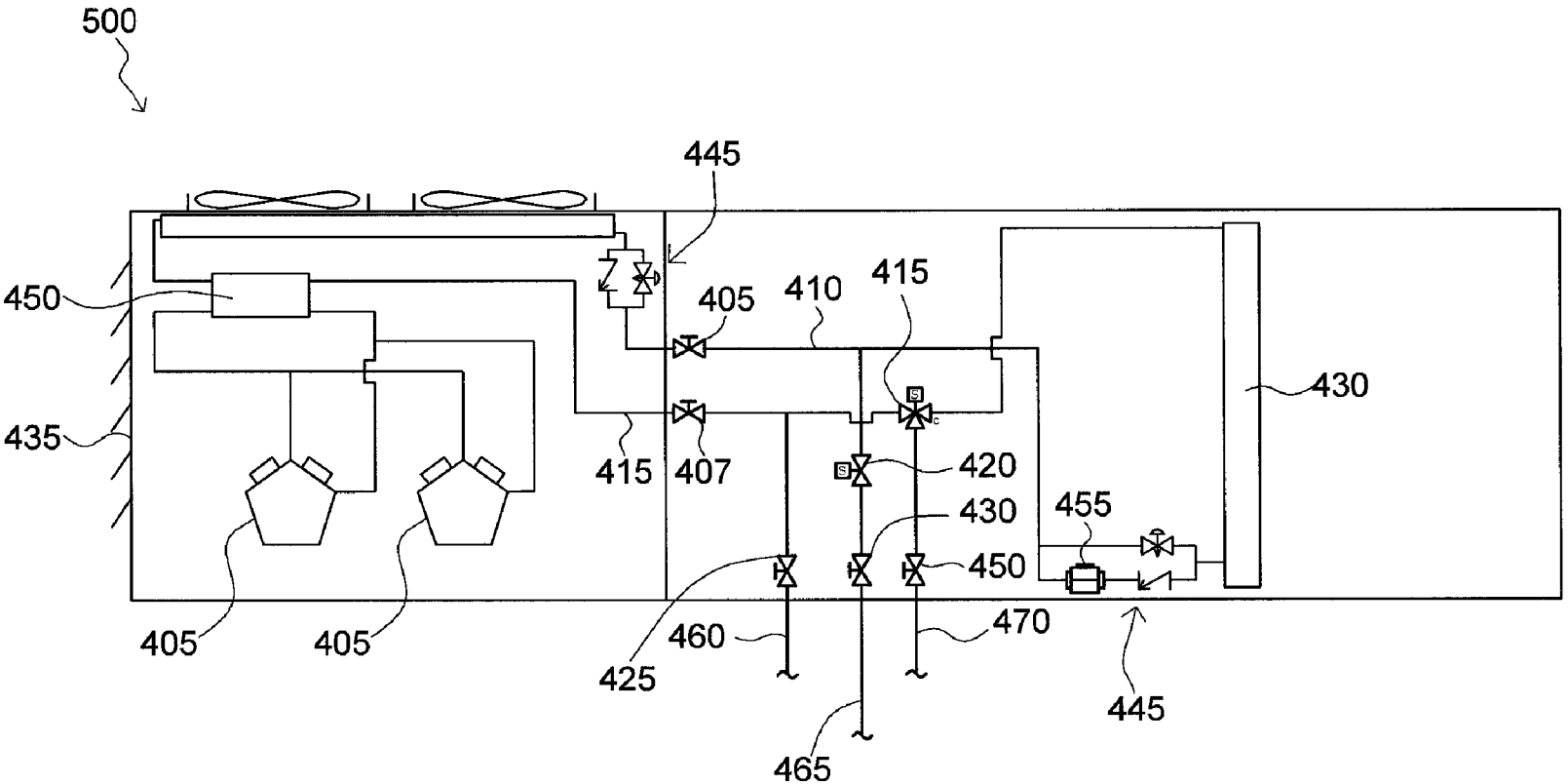
FIG. 5 is a schematic of a retrofitted version of the air source heat pump RTU shown in FIG. 4 according to one embodiment of the present invention.

FIG. 5 is a schematic of a retrofitted RTU 500 based on the air source heat pump RTU 400 shown in FIG. 4. FIG. 5 represents a schematic view of a typical air source heat pump RTU that has been modified pursuant to an embodiment of the invention described herein to be served by a centralized, refrigeration system (not shown but similar to the refrigeration system of FIG. 3). Accordingly, the components and elements of the retrofitted RTU are generally similar as those identified for the RTU 400 of FIG. 4 unless otherwise specifically noted.

Isolation valves 405, 407, 425, 430 and 450 are in place to enable isolation and switching back and forth between the original existing air source heat pump RTU compressor and outdoor air coil circuit and the centralized refrigeration system. A new trap 455 may also be added. When operated off of the centralized refrigeration system isolation valves 405 & 410 would normally be in the closed position thereby blocking refrigerant flow to and from the RTU's compressor(s) and outdoor air coil portion of the refrigeration circuit and isolation valves 425, 430 & 450 would normally be in the open position thereby enabling refrigerant flow to and from the centralized refrigerant system via conduits 460, 465 & 470 to and from the RTU's indoor air heating/cooling coil(s). Conversely, when functioning off of the original existing air source heat pump RTU compressor, outdoor air coil, circuit isolation valves 405 & 407 would normally be in the open position thereby enabling refrigerant flow to and from the original existing RTU compressor, outdoor air coil, circuit, and isolation valves 425, 430 & 450 would normally be in the closed position thereby blocking refrigerant flow to and from the centralized refrigeration system.

Conduit 465 supplies a pressurized refrigerant liquid from the centralized refrigeration system to the RTU when the RTU is in cooling mode. When in heating mode conduit 465 returns condensed liquid from the RTU's indoor air cool to the centralized refrigeration distribution system. This liquid can be transferred to other RTUs on the system that happen to be in cooling mode at the time, or simply returned to the central refrigeration system when it can be provided with heat to absorb thereby transition back into a vapor for recompression and redistribution to RTUs on the system calling for heating. Conduit 470 returns refrigerant vapor from the RTU to the centralized refrigeration system when the RTU is in cooling mode. Conduit 460 supplies hot refrigerant gas, or high pressure compressor discharge refrigerant gas, from the centralized refrigeration system to the indoor air cool(s) during RTU heating mode. On a call for cooling by the air source heat pump RTU, the RTU's compressor(s) would normally, prior to the modifications of the present invention, be engaged to collect and compress refrigerant vapor from the indoor air coil(s) and send this pressurized gas to the outdoor air coil where is can reject heat and be condensed to a liquid state. Rather than engaging the compressor when there is a demand for cooling on the air source heat pump RTU, the retrofitted system of this invention would open up solenoid valve 420 to allow liquid refrigerant via conduit 465 from the centralized system to enter the evaporator/cooling coil via an expansion, or pressure letdown device. The refrigerant in the evaporator/cooling coil would absorb heat and go through a phase change from a liquid to a gas just as it normally would in a standard refrigeration cycle. The refrigerant gas would then be returned to the centralized refrigeration system through the 3-way solenoid valve 415 via conduit 470 for compression and re-liquefaction via a centralized water cooled condenser system. On a call for heating by the air source heat pump RTU, the RTU's compressor(s) would normally, prior to the modifications of the present invention, be engaged to collect and compress refrigerant vapor from the outdoor air coil which has absorbed heat from the environment and send this pressurized gas to the indoor air coil(s) where is can reject heat and be condensed to a liquid state thereby providing heating to the space being conditioned. Rather than engaging the compressor when there is a demand for heating on the air source heat pump RTU, the retrofitted system of this invention would switch solenoid valve 415 to allow hot refrigerant gas via conduit 460 from the centralized system to enter the indoor air coil(s). The refrigerant in the indoor air coil would release heat and go through a phase change from a gas to a liquid just as it normally would in a heat pump cycle. The refrigerant liquid would then be returned to the centralized refrigeration distribution system through the open solenoid valve 420 via conduit 465.

When multiple air source heat pump RTUs are combined onto a centralized system those RTUs that are serving areas which are requiring cooling, such as building "core" zones, or computer rooms or other areas with equipment that generates large amounts of heat the needs to be removed, can move and reclaim heat from those areas being cooled and transfer it to RTUs which are serving areas which are calling for heating, such as areas with high outdoor air volume requirements during the heating season, or perimeter areas of the building being served resulting in energy conservation.

In these manners a centralized refrigeration system can be retrofitted to an existing RTU or series of RTUs, be them standard cooling only circuits, or heat pump circuits, via the present invention described herein, to provide potential: energy saving benefits, decreased maintenance, and increased reliability through added redundancy.

The invention claimed is:

1. A cooling system for a building, the system comprising:

a plurality of roof top units, each roof top unit including, (i) one or more compressors, (ii) at least one outdoor coil, (iii) at least one expansion device, (iv) at least one indoor coil, (v) refrigerant pipes coupling the one or more compressors, the at least one outdoor coil, the at least one expansion device and the at least one indoor coil in a loop, the piping being configured to contain and permit the flow of refrigerant, (vi) a housing substantially containing the one or more compressors, the at least one outdoor coil, the at least one expansion device, the at least one indoor coil, and the piping, (vii) at least one first valve configured to selectively isolate flow of refrigerant through the refrigerant pipes between the indoor and outdoor coils, (viii) at least one pair of pipes exiting the roof top unit, the at least one pair of pipes being fluidly coupled to the refrigerant pipes, (ix) at least one second valve configured to selectively permit flow of refrigerant from the indoor coil through at least one pair of pipes exiting the roof top unit;

a centralized refrigeration unit, the centralized refrigeration unit being separate and distinct from each of the plurality of roof top units and including at least one compressor; and connector pipes coupling the at least one pair of pipes exiting each roof top unit to the centralized refrigeration unit.

2. The cooling system of claim 1, wherein the centralized refrigeration unit is a water-cooled system.

3. The cooling system of claim 1, wherein the at least one indoor coil comprises a cooling coil and the at least one outdoor coil comprises a condenser coil.

4. The cooling system of claim 1, wherein each roof top unit further includes at least one solenoid valve, the solenoid valve configured to permit the flow of refrigerant through refrigerant pipes from the at least one pair of pipes and the connector pipes from the centralized refrigeration unit to the expansion device and the indoor coil.

5. The cooling system of claim 1, wherein each of the plurality of roof top units comprises a heat pump.

6. The cooling system of claim 1, wherein each of the plurality of roof top units comprises an air conditioner.

7. A method of making a cooling system, the method comprising:

providing a plurality of roof top units, each roof top unit including, (i) one or more compressors, (ii) at least one outdoor coil, (iii) at least one expansion device, (iv) at least one indoor coil, (v) refrigerant pipes coupling the one or more compressors, the at least one outdoor coil, the at least one expansion device and the at least one indoor coil in a loop, the piping being configured to contain and permit the flow of refrigerant therein, (vi) a housing substantially containing the one or more compressors, the at least one outdoor coil, the at least one expansion device, the at least one indoor coil, and the piping, (vii) at least one first valve configured to selectively isolate flow of refrigerant through the refrigerant pipes between the indoor and outdoor coils, (viii) at least one pair of pipes exiting the roof top unit, the at least one pair of pipes being fluidly coupled to the refrigerant pipes, (ix) at least one second valve configured to selectively permit flow of refrigerant from the indoor coil through at least one pair of pipes exiting the roof top unit;

providing a centralized refrigeration unit;

the centralized refrigeration unit being separate and distinct from each of the plurality of roof top units and including at least one compressor; and connector pipes coupling the at least one pair of pipes exiting each roof top unit to the centralized refrigeration unit;

operatively coupling the at least one pair of pipes to the refrigerant pipes;

installing the at least one first valve;

installing the at least one second valve; and operatively coupling the at least one pair of pipes to the connector pipes.

8. The method of claim 7, wherein the plurality of roof top units were provided already operatively installed on a building.

9. A method of operating a cooling system of claim 1, the method comprising:

a plurality of roof top units, each roof top unit including, (i) one or more compressors, (ii) at least one outdoor coil, (iii) at least one expansion device, (iv) at least one indoor coil, (v) refrigerant pipes coupling the one or more compressors, the at least one outdoor coil, the at least one expansion device and the at least one indoor coil in a loop, the piping being configured to contain and permit the flow of refrigerant therein, (vi) a housing substantially containing the one or more compressors, the at least one outdoor coil, the at least one expansion device, the at least one indoor coil, and the piping, (vii) at least one first valve configured to selectively isolate flow of refrigerant through the refrigerant pipes between the indoor and outdoor coils, (viii) at least one pair of pipes exiting the roof top unit, the at least one pair of pipes being fluidly coupled to the refrigerant pipes, (ix) at least one second valve configured to selectively permit flow of refrigerant from the indoor coil through at least one pair of pipes exiting the roof top unit;

a centralized refrigeration unit, the centralized refrigeration unit being separate and distinct from each of the plurality of roof top units and including at least one compressor; and connector pipes coupling the at least one pair of pipes exiting each roof top unit to the centralized refrigeration unit;

closing the at least one first valve to prevent the flow of refrigerant between the indoor and outdoor coils; and opening the at least one second value to permit flow of refrigerant between the indoor coil and the centralized refrigeration unit.

10. The method of claim 9, wherein each roof top unit further includes at least one solenoid valve, the solenoid valve configured to permit the flow of refrigerant through refrigerant pipes from the at least one pair of pipes and the connector pipes from the centralized refrigeration unit to the expansion device and the indoor coil, and the method further comprises opening the solenoid valve to facilitate the flow of refrigerant to the indoor coil.

* * * * *